US007090767B2

(12) United States Patent
Kaminsky et al.

(10) Patent No.: US 7,090,767 B2
(45) Date of Patent: Aug. 15, 2006

(54) HYDRODESULFURIZATION OF GASOLINE FRACTIONS

(75) Inventors: Mark P. Kaminsky, Friendswood, TX (US); Kenneth M. Webber, Friendswood, TX (US)

(73) Assignee: Equistar Chemicals, LP, Houston, TX (US)

( * ) Notice: Subject to any disclaimer, the term of this patent is extended or adjusted under 35 U.S.C. 154(b) by 833 days.

(21) Appl. No.: 10/138,218

(22) Filed: May 2, 2002

(65) Prior Publication Data

US 2003/0205504 A1 Nov. 6, 2003

(51) Int. Cl.
*C10G 47/12* (2006.01)
*C10G 65/12* (2006.01)
*C10G 45/10* (2006.01)

(52) U.S. Cl. ..... 208/217; 208/58; 208/210; 208/213; 208/216 R; 208/218; 208/111.3; 208/111.35; 208/120.3; 208/120.35; 203/DIG. 6

(58) Field of Classification Search ..... 208/210, 208/213, 216 R, 217, 218, 58, 111.3, 111.35, 208/120.3, 120.35; 203/DIG. 6
See application file for complete search history.

(56) References Cited

U.S. PATENT DOCUMENTS 3,537,977 A * 11/1970 Smith, Jr. ..... 208/89
3,709,814 A * 1/1973 Jaffe ..... 502/66
4,983,273 A * 1/1991 Kennedy et al. ..... 208/89
5,847,249 A * 12/1998 Maraschino ..... 585/259
6,083,378 A * 7/2000 Gildert et al. ..... 208/209
6,303,020 B1 10/2001 Podrebarac et al. ..... 208/210
6,334,948 B1 1/2002 Didillon et al. ..... 208/218
6,416,659 B1 * 7/2002 Groten et al. ..... 208/213
6,440,299 B1 * 8/2002 Hearn et al. ..... 208/189
6,444,118 B1 * 9/2002 Podrebarac et al. ..... 208/210
6,495,030 B1 * 12/2002 Podrebarac ..... 208/218

OTHER PUBLICATIONS

Isao Mochida et al., *Deep hydrodesulfurization of diesel fuel: Design of reaction process and catalysts*, Catalysis Today, Elsevier, 1996, vol. 29, pp. 185-189.
Johan W. Gosselink, *Sulfide catalysts in refineries*, CATTECH, Baltzer Science Publishers, Dec. 1998, vol. 2, No. 2, pp. 127-144.

* cited by examiner

*Primary Examiner*—Tam M. Nguyen
(74) *Attorney, Agent, or Firm*—Roderick W. MacDonald

(57) ABSTRACT

A method for processing a gasoline range hydrocarbon stream wherein a single reactor/distillation tower stream is fractionated into a light fraction and a heavy fraction, the light fraction is hydrodesulfurized, the heavy fraction is optionally hydrocracked and then hydrodesulfurized, and the light and heavy fractions are separately recovered.

13 Claims, No Drawings

HYDRODESULFURIZATION OF GASOLINE FRACTIONS

BACKGROUND OF THE INVENTION

1. Field of the Invention

This invention relates to the processing of a hydrocarbon stream that is generally in the gasoline boiling range to remove sulfur therefrom. This invention also relates to enhancing at least a fraction of said stream by catalytic cracking while desulfurizing same.

2. Description of the Prior Art

Gasoline boiling range hydrocarbon streams are routinely generated by various processes in crude oil refineries or chemical plants. For example, a hydrocarbon stream containing gasoline boiling range hydrocarbons and other hydrocarbons outside the gasoline boiling range, e.g., a vacuum gas oil, is conventionally catalytically cracked in a refinery to produce gasoline boiling range material. Some chemical plants are designed to steam crack various liquid hydrocarbon feedstocks, such as straight run naphtha to produce light olefins (ethylene, propylene, butenes, etc.) and aromatics (benzene, toluene, xylenes, etc.). Steam cracking also produces an important by-product known as pyrolysis gasoline ("pygas") which is generally within the gasoline boiling range. These various gasoline streams are ultimately blended with one another and/or other gasoline streams to form a finished, commercial gasoline product for sale to the public.

Due to environmental regulations, the level of total sulfur allowed in finished gasoline has been reduced and likely will be reduced more in the future. Accordingly, it is important to reduce the sulfur content of the various gasoline blending streams that go into formulating finished gasolines.

For example, pygas is used as a gasoline blending stream and is desirably desulfurized to some extent before the gasoline blending operation. The lower the sulfur content of such a blending stream the more valuable it is because of the low sulfur requirements for finished gasoline. This assumes that the octane is not significantly lowered from hydrodesulfurization. Currently, full range pygas from a cracking plant is first stabilized in a stand-alone, first-stage hydrotreater to remove reactive olefins. Thereafter, the pygas is fractionated (split) in a separate, upright splitter tower into a light pygas fraction and a heavy pygas fraction. The light fraction is desulfurized in a separate hydrodesulfurization ("HDS") unit and then subjected to solvent extraction for the separate recovery of aromatics. The heavy fraction is sent to gasoline blending without HDS processing.

Due to ever tightening environmental regulations, it is desirable to desulfurize the heavy pygas before sending it to gasoline blending, but not necessarily to the same sulfur specifications as those set for the light pygas. Desulfurization of the heavy pygas could desirably reduce its sulfur content below the legal requirement or even well below such requirement thereby rendering that heavy pygas more valuable as a blending stock since it would meet or exceed sulfur requirements for the finished gasoline even before blending.

Heretofore, it has been taught to subject both light and heavy catalytically cracking gasoline fractions to HDS, see U.S. Pat. No. 6,334,948 (Didillon et al.). Didillon et al. contemplate the use of a distillation zone to form the light and heavy fractions with HDS zones outside or inside the distillation zone. To achieve their desired results, Didillon et al. require the use of a wholly nickel based catalyst on the light fraction and the use of a conventional HDS catalyst such as a Co/Mo based catalyst on the heavy fraction. Didillon et al. show by way of their Example 3 that when not using an entirely nickel based catalyst on the light fraction, but rather using a conventional HDS catalyst on both the light and the heavy fractions, their desired sulfur reduction results were not achieved as represented in their Tables 7–8. Further, Didillon et al. require mixing of the light and heavy fractions after subjecting each fraction to HDS. Accordingly, Didillon et al. not only teach, but require both HDS of the light fraction with a catalyst containing solely nickel, and mixing of the light and heavy fractions after HDS of each fraction. Additional teaching of related art was done by Johan W. Gosselink ("Sulfide Catalysts in Refineries"; CATTECH, Vol. 2, No. 2, December 1998 pp. 127–144). In FIG. 9 he teaches the use of a catalytic distillation tower/reactor to hydrodesulfurize, a lighter fraction with a $CoMo/Al_2O_3$ catalyst, and hydrodesulfurize, a heavier fraction using $NiMo/Al_2O_3$ beds. He teaches using a gas oil feed to produce a low sulfur diesel product by combining the two (light and heavy) desulfurized streams. This invention teaches away from this art by having a lighter gasoline range feed and separating the light and heavy product.

SUMMARY OF THE INVENTION

In accordance with this invention, in a unitary, stand-alone reactor/distillation tower (zone), a gasoline boiling range feed stream such as pygas is split into a lower boiling (light) fraction and a higher boiling (heavy) fraction and each fraction is subjected to HDS in the same tower, but with different catalyst beds. The light pygas is desulfurized with a conventional HDS catalyst that is not nickel based, viz., is not wholly based on, nor solely contains, nickel metal by itself as required by Didillon et al.

Said separate light and heavy fractions, after HDS of each, are, pursuant to this invention, not mixed together, but rather kept separate. Contrary to Didillon et al. and Gosselink, no mixing of light and heavy fractions is required by this invention in order to meet its desired results. Mixing of the light and heavy fractions of this invention after HDS is permissible, e.g., in final blending operations, but certainly is not required. Such mixing can even be undesirable at times because, by this invention, the light and heavy fractions, after HDS, can be at quite different sulfur levels as shown hereinafter, and maximum blending efficiencies can sometimes be achieved by keeping the two fractions separate until final blending decisions are made later during final downstream blending. It is possible that the light and heavy desulfurized fractions of this invention are never mixed with each other. For example, the light fraction could be subjected to aromatic extraction before being added to a finished gasoline stream while the heavy fraction is added to a second separate finished gasoline stream. Accordingly, this invention allows for more flexibility in the making of final blending decisions due to its separately recovered fractions.

Further, in this invention the heavy fraction can be upgraded by subjecting same to catalytic cracking in the same unitary reactor/distillation tower before HDS of same thereby producing an enriched heavy fraction that is significantly reduced in gums and gum precursors.

DETAILED DESCRIPTION OF THE INVENTION

Reactor/distillation towers or zones are well known in the art, see Mochida et al., "Catalysis Today," Volume 29, pp. 185–189, published by Elsevier (1996). Basically they are a distillation column (tower) that also contains catalyst so that fractionation and reaction occur concurrently in the tower. See U.S. Pat. No. 6,303,020 (Podrebarac et al.).

This invention employs a single (unitary) such a tower (zone) for accomplishing all the process steps of this invention. Such stand-alone, upright tower carries out all the HDS and hydrocracking processes of this invention and produces therefrom the desired desulfurized, and otherwise enhanced, separate light and heavy gasoline boiling range products (fractions) of this invention. Such products are useful separately or combined in subsequent blending operations. The tower employs as feed thereto a hydrogen containing stream and a separate gasoline boiling range hydrocarbon stream to be processed pursuant to this invention.

Any conventional hydrogen containing stream suitable for HDS can be employed as the hydrogen feed. Any hydrocarbon stream which is essentially, but not necessarily entirely, in the gasoline boiling range can be employed as the hydrocarbon feed. The gasoline boiling range can vary but is generally from about 100 to about 435° F.

The hydrogen stream is fed into or near the bottom of the tower and rises to the top of the tower. The hydrocarbon stream, after stabilization and preheating to partial or full vaporization, is fed into a central (middle) portion or section of the tower. Due to the operating conditions in the tower, the hydrocarbon stream is split in said central section into a vaporous light fraction ($C_5$–$C_8$, inclusive) which rises to the top of the tower, and a separate, essentially liquid heavy fraction ($C_9$ and heavier) which falls to the bottom of the tower. The tower can employ a conventional reflux loop at its top for recycling some overhead light fraction material, after cooling or heating of same, to an upper portion of the tower, preferably in the vicinity of the top and/or bottom of the HDS catalyst in the upper portion of the tower that treats said light fraction. The tower can also employ a conventional reboiler loop for recycling heavy fraction material from a lower portion of the tower, after heating of same, back to the lower portion of the tower, preferably at or near the top of the uppermost catalyst bed used for treating the heavy fraction, viz., at or near the top of the heavy fraction HDS catalyst if no cracking catalyst is present, or at or near the top of the cracking catalyst bed if it is present in the lower portion of the tower above the HDS catalyst for the heavy fraction.

Above the area in the tower where the hydrocarbon feed is split into a light, rising fraction and a heavy, falling fraction, an HDS catalyst is provided so that the rising light fraction has to pass through this catalyst before it reaches the top of the tower for exiting the tower. This light fraction HDS catalyst consists essentially of at least one combination of at least one Group VIII metal (iron, ruthenium, osmium, cobalt, rhodium, iridium, nickel, palladium, or platinum), and at least one Group VI-B metal (chromium, molybdenum, or tungsten), supported or unsupported. In this invention, light fraction HDS catalyst is not nickel based. That is to say it is not based solely and exclusively on nickel alone as required by Didillon et al. The light fraction HDS catalyst is held in place in the tower by use of conventional devices such as screens above and below the catalyst bed and/or porous metal sacks or canisters containing the catalyst. This catalyst is essentially low in acidity. If supported, the catalyst metal combination would be dispersed on a conventional porous solid such as alumina, silica-alumina; or other porous solids such as magnesia, silica, or titanium oxide, used alone or in combination with alumina and/or silica alumina.

Examples of suitable catalysts known in the art and commercially available are $CoMo/Al_2O_3$, $NiMo/Al_2O_3$, $NiCoMo/Al_2O_3$, and the like, and mixtures thereof. Such catalysts are preferably employed in a partially sulfided form as is well known in the art, see Didillon et al. The light fraction HDS catalyst can be modified/promoted in a conventional manner such as by the addition to the catalyst of an alkali metal and/or alkaline earth metal to modify catalyst acidity, Lanthanide series oxides to improve the supports' structural integrity, etc. Other known modifiers/promoters can be added to the catalyst to make it more robust in the presence of poisons. Poisons that affect the catalyst life are materials that plug pores, such as silicon oxide dusts or reactive species that can chemically bond to the support or active metal, such as siloxane type components, mercury, lead, arsenic, vanadium, ammonia, amines, chlorides, or bromides.

The combination metal light fraction HDS catalysts of this invention are, unlike nickel based catalysts, highly tolerant to exposure to sulfur and its compounds and will not lose their HDS activity with heavy and/or prolonged exposure to sulfur containing compounds such as $H_2S$.

The overhead product separated from the tower, and after $H_2S$ separation, is the hydrodesulfurized light fraction product of this invention and is essentially composed of $C_5$–$C_8$, inclusive, hydrocarbons including aromatics (benzene, toluene, xylenes, etc.). This product can be used as a gasoline blending stock by itself, and, therefore, need not be, and preferably is not, blended with the heavy fraction product recovered from the bottom of the tower. The light fraction product can have a total sulfur content of less than about 30 ppm sulfur. If the light fraction is to be subjected to solvent extraction in a conventional manner such as with a UDEX or Sulfolane process to separately recover valuable aromatics, its sulfur content is preferably reduced to 1 ppm sulfur or less.

Below the area in the tower where the hydrocarbon feed is split, a conventional HDS catalyst is employed so that the descending heavy fraction will pass through that catalyst. The heavy fraction catalyst can be at least one Group VIII metal and/or at least one Group VI-B metal, both as defined hereinabove, supported or unsupported. This catalyst has lower acidity. This catalyst is similar to that used for the light fraction catalyst, and can be modified/promoted as described above. This catalyst can be physically carried in the tower in a conventional manner as described above for the light fraction catalyst. The heavy fraction will predominantly be in the liquid phase which helps wash gums off the catalyst.

Pursuant to another embodiment of this invention, below the area in the tower where the hydrocarbon feed is split, but above the heavy fraction HDS catalyst, there can be employed a cracking catalyst so that the heavy fraction is subjected to catalytic cracking before HDS. This upgrades and enhances the quality of the heavy fraction product of this invention after HDS because this cracking step, among other things, reduces gums and gum precursors. Pursuant to this aspect of the invention, a hydrocracking catalyst is employed that favors the cracking of high boiling species that would exceed the gasoline boiling range limits for final boiling point specifications for finished gasoline. Such species are generally oligomers of at least one of isoprene; $C_5$–$C_{11}$, inclusive, diolefins; cyclopentadiene; substituted (e.g., methyl, ethyl, etc., substituted); dicyclopentadiene; substituted dicyclopentadiene; dihydro dicyclo pentadiene; substituted dihydro dicyclo pentadiene; styrene; indene; naphthalene; and the like.

The hydrocracking catalyst of this invention can be at least one combination of at least one Group VIII metal, at least one Group VI-B metal, both Groups as defined above, and at least one acidic support that favors hydrocracking of hydrocarbons, particularly gasoline range hydrocarbons. The support is preferably acidic as determined by methods known in the art, with a an acid dissociation (ionization) constant (pKa) not lower than about −5.6. Suitably known and commercially available catalysts include acidic NiMo/$Al_2O_3$, NiMo/$Al_2O_3SiO_2$, NiW/$Al_2O_3$, NiW/$Al_2O_3SiO_2$, acidic NiCoMo/$Al_2O_3$, and acidic NiCoMo/$Al_2O_3SiO_2$. Suitable supports include silica and/or alumina (crystalline or amorphous), sulfated zirconia, silica alumina phosphate, Group VIII metal aluminum phosphate, zeolite Y, pentasil, MCM22, dealuminated mordenite, and beta zeolite, see Handbook of Commercial Catalysts by H. F. Rase, CRC Press (2000). These supports can, if desired, be modified with materials such as boron trifluoride, boron oxides, $AlCl_3$, phosphoric acid, hydrochloric acid, nitric acid and the like as is known in the art. The hydrocracking catalyst bed can also include non-acidic hydrotreating catalyst to hydrogenate gum precursors and desulfurize.

For more information concerning acidic and basic metal oxides and supports, see Design of Industrial Catalysts by D. L. Trimm, Chemical Engineering Monographs, Vol. II, Elsevier Scientific Publishing Co. (1980).

It is known in the art that HDS catalyst is preferably partially or fully sulfided to be selective for HDS, see Didillon et al. This is problematic for nickel based catalyst which, when partially sulfided is very selective for certain hydrogenation processes such as the conversion of diolefins to monoolefins. But when nickel is totally sulfided it becomes inactive for hydrogenation. The HDS catalysts useful in this invention are highly tolerant to sulfur exposure without loss of HDS activity. When using sulfided HDS catalysts in this invention some sulfur may be lost from the catalysts during HDS, which is needed to maintain their HDS activity. In the use of the sulfided HDS catalysts of this invention, particularly in the heavy fraction catalyst bed, $H_2S$ is generated which then rises through the catalyst beds thereabove toward the top of the tower. This in situ generated $H_2S$ provides replacement sulfur for maintaining the desired HDS activity of the upper catalyst, particularly the light fraction HDS bed.

The heavy fraction product of this invention removed from the bottom of the tower is within the gasoline boiling range with minimized hydrogenation of mono-olefins and aromatics thereby maintaining its octane value. It will generally have less than about 30 ppm sulfur. It is removed from the tower separately from the light fraction overhead product and kept separate until later gasoline blending operations are undertaken, thus keeping the maximum number of options open for subsequent blending decisions.

This invention thus increases the flexibility and efficiency of downstream blending operations. Other advantages for this invention include capital and operating cost savings resulting from using a single tower as compared to operating an independent distillation tower and separate HDS units for each of the light and heavy fractions. The tower configuration of this invention can also be operated at a lower pressure than a conventional HDS unit and still achieve the desired degree of sulfur reduction.

The operating conditions of the tower can vary widely, but will generally be from about 250 to about 800° F., preferably from about 350 to about 750° F., more preferably from about 400 to 750° F., at a pressure of from about 10 to about 2,000 psig, preferably from about 50 to about 1,000 psig, more preferably from about 100 to about 600 psig; a hydrogen feed rate of from about 100 to about 10,000 standard cubic feet per barrel, preferably from about 200 to about 5,000 standard cubic feet per barrel, more preferably from about 400 to about 3,000 standard cubic feet per barrel; and a tower weight hourly space velocity in the range of from about 0.5 to about 20 $h^{-1}$, preferably from about 1 to about 10 $h^{-1}$, more preferably from about 2 to about $6h^{-1}$.

EXAMPLE

A full boiling range pygas containing about 40% $C_3$-$C_{10}$ hydrocarbons (saturates, olefins, and diolefins); about 54% of a mixture of benzene, ethylbenzene, toluene, and xylenes; and about 4% styrene with the remainder being $C_{11}$ and heavier hydrocarbons, all percentages being by weight, and having a sulfur content of about 150 ppm is introduced into a central portion of a single reactor/distillation tower operating at about 500° F., about 400 psig, and a weight hourly space velocity of about $10h^{-1}$. A hydrogen feed stream is introduced into the bottom of the tower at about 1,500 standard cubic feet per barrel.

The full range pygas is split in said tower into a light fraction ($C_5$–$C_8$, inclusive) and a heavy fraction ($C_9$ and heavier). The vaporous light fraction travels upwardly in said tower through a commercial HDS catalyst bed composed of non-acidic CoMo/$Al_2O_3$, and leaves the top of the tower with a sulfur content, after $H_2S$ separation, of less than 10 ppm. The heavy fraction ($C_9$ and heavier) which did not flash or has condensed in the tower travels downwardly in the tower through two catalyst beds, the first and upper most bed containing a commercial acidic NiMo/alumina hydrocracking catalyst, and the second lower most bed containing commercial HDS catalyst composed of less acidic CoMo/$Al_2O_3$. The heavy pygas fraction leaves the lower end of the tower with a sulfur content of about 30 ppm.

The light and heavy products are not mixed with one another, but are separately sent to the gasoline blending pool or to extraction of certain aromatics.

What is claimed is:

1. A method for processing a hydrocarbon containing stream which is essentially in the gasoline boiling range comprising providing a unitary reactor/distillation zone, separating said stream into a light fraction, and a heavy fraction; hydrodesulfurizing said light fraction in said zone using a catalyst which is effective for hydrodesulfurizing and is not nickel based, catalytically cracking said heavy fraction in the presence of hydrogen in said zone, after said catalytic cracking hydrodesulfurizing said heavy fraction in said zone using a catalyst effective for hydrodesulfurization, and separately recovering the light and heavy fractions from said zone without mixing same.

2. The method of claim 1 wherein said separately recovered fractions are not mixed together prior to downstream gasoline blending operations.

3. The method of claim 2 wherein said fractions are not mixed during said blending operations.

4. The method of claim 1 wherein said light fraction hydrodesulfurization catalyst consists essentially of at least one Group VIII metal and at least one Group VI-B metal.

5. The method of claim 4 wherein said catalyst is supported.

6. The method of claim 1 wherein said heavy fraction hydrodesulfurization catalyst consists essentially of at least one Group VIII metal and/or at least one Group VI-B metal.

7. The method of claim 6 wherein said catalyst is supported.

8. The method of claim 1 wherein said cracking catalyst favors cracking high boiling species that would exceed the gasoline boiling range limits for a finished gasoline.

9. The method of claim 1 wherein said cracking catalyst consists essentially of at least one Group VIII metal, at least one Group VI-B metal, and at least one acidic support that favors hydrocracking.

10. The method of claim 9 wherein said acidic support has a pKa not lower than about −5.6.

11. The method of claim 1 wherein said acidic support is at least one selected from the group consisting essentially of silica, alumina, sulfated zirconia, silica alumina phosphate, a Group VIII metal aluminum phosphate, zeolite Y, pentasil, MCM22, dealuminated mordenite, and beta zeolite.

12. The method of claim 1 wherein said zone is operated at a temperature of from about 250 to about 800° F., a pressure of from about 10 to about 2000 psig, and a weight hourly space velocity of from about 0.5 to about 20 $h^{-1}$.

13. The method of claim 1 wherein hydrogen sulfide is generated in situ in said heavy fraction hydrodesulfurization catalyst in said zone and is employed in part to sulfidize at least said light fraction hydrodesulfurization catalyst as needed to maintain the hydrodesulfurization activity of said light fraction catalyst.

* * * * *